United States Patent [19]

Loeven

[11] Patent Number: 5,041,828

[45] Date of Patent: Aug. 20, 1991

[54] DEVICE FOR MONITORING TRAFFIC VIOLATING AND FOR RECORDING TRAFFIC STATISTICS

[75] Inventor: Hans-Gerd Loeven, Duisburg, Fed. Rep. of Germany

[73] Assignee: Robot Foto und Electronic GmbH u. Co. KG, Fed. Rep. of Germany

[21] Appl. No.: 230,844

[22] Filed: Aug. 10, 1988

[30] Foreign Application Priority Data

Aug. 19, 1987 [DE] Fed. Rep. of Germany ..... 3727562

[51] Int. Cl.[5] ..... G08G 1/017

[52] U.S. Cl. ..... 340/937; 340/936; 346/107 VP

[58] Field of Search ..... 340/941, 937, 933, 934, 340/936, 441, 928; 346/107 VP, 33 D; 358/108

[56] References Cited

U.S. PATENT DOCUMENTS

| | | | |
|---|---|---|---|
| 3,165,373 | 1/1965 | Scott | 340/937 |
| 4,173,010 | 10/1979 | Hoffmann | 340/937 |
| 4,887,080 | 12/1989 | Gross | 340/937 |
| 4,922,339 | 5/1990 | Stout et al. | 340/937 |

FOREIGN PATENT DOCUMENTS

| | | | |
|---|---|---|---|
| 0067905 | 11/1981 | European Pat. Off. . | |
| 1172066 | 6/1964 | Fed. Rep. of Germany . | |
| 3306040 | 8/1984 | Fed. Rep. of Germany . | |
| 3422764 | 1/1986 | Fed. Rep. of Germany . | |
| 2549263 | 1/1985 | France . | |
| 2549625 | 1/1985 | France | 340/933 |
| 013730 | 11/1978 | Japan | 340/937 |
| 0767810 | 9/1980 | U.S.S.R. | 340/936 |
| 1494945 | 12/1977 | United Kingdom . | |

*Primary Examiner*—Joseph A. Orsino, Jr.
*Assistant Examiner*—Brent A. Swarthout
*Attorney, Agent, or Firm*—Lee, Mann, Smith, McWilliams & Sweeney

[57] ABSTRACT

A photographic traffic monitoring device comprises a sensor responding to passing vehicles, for example, an induction loop imbedded in the road for monitoring traffic lights or a Doppler radar. From a signal evaluation it is determined whether a detected vehicle has violated a traffic regulation, e.g. exceeded the allowed maximum speed limit. When such a violation takes place, a camera is automatically released and the monitored vehicle is photographed. In order to collect data for statistical purposes about traffic events obtained with such devices, a memory function is provided. This function records events detected by the device, events which are not restricted to violations of traffic regulations.

6 Claims, 4 Drawing Sheets

DEVICE FOR MONITORING TRAFFIC VIOLATING AND FOR RECORDING TRAFFIC STATISTICS

TECHNICAL FIELD

The invention relates to a traffic monitoring device comprising a sensor responding to passing vehicles, means for determining violation of traffic regulations by the passing vehicle, and means for recording such a vehicle, which recording means are controlled by said means for determining violation of traffic regulations.

A common method of recording is a device for photographic traffic monitoring, by which a photographic picture is taken of the vehicle when violation of a traffic regulation is determined. Traffic light monitoring devices or photographic speed monitoring devices operating with Doppler radar are examples of such devices.

BACKGROUND ART

Devices for automatic photographic monitoring of road intersections controlled by traffic light are known. A sensor, e.g. an induction loop imbedded in the road, supplies a signal when a vehicle enters a road intersection monitored by a traffic light. The traffic light supplies a further signal when the traffic light changes to its stop phase. If the vehicle enters the road intersection during the stop phase, a photographic picture is triggered, which records the vehicle and its licence number. Thus, the vehicle can be identified and the violation can be evidentially recorded. In order to improve the evidential value of the photographic registration, several pictures are usually taken one after the other.

Such devices are, for example, described in German Patent 683,658, U.S. Pat. No. 2,871,088, Austrian Patent 225,077, German Patent 1,078,797, an essay in "Polizei, Technik, Verkehr" issue 8 (1965), 269–272 and German Patent 2,365,331.

It is well known that it is possible to measure the speed of a vehicle and to release a photographic picture when exceeding an allowed maximum speed limit. This picture clearly records the vehicle with its licence number.

Austrian Patent 225,077 already mentioned describes in an embodiment a traffic monitoring device having two sensors fixedly spaced from each other in the road. A camera is released and the vehicle is photographed when the time interval between the passing over of the two sensors drops below a predetermined value. A similar device is described in Austrian Patent 246,617.

Furthermore, it is well known that two pictures are taken in fixed time intervals, when the passing vehicle exceeds the allowed maximum speed limit which is signalled by the two sensors arranged in the road and by the evaluation circuit to which the signals from the sensors are applied. A further measuring value of the speed can be obtained from the positions of the vehicle on the two pictures.

Furthermore, it is well known that the speed of a vehicle may be determined by using a Doppler radar. Such a speed monitoring device is described, for example, in U.S. Pat. No. 2,683,071, Swiss Patent 414,210 or Swiss Patent 470,674. In usual photographic speed monitoring devices having Doppler radar, the measured speed is indicated. The vehicle to be monitored is photographed when it exceeds the allowed maximum speed limit and the indication of the actual speed as measured is reflected in the picture (for example German Democratic Patent 66,974).

Practically every one of the devices mentioned above for traffic monitoring comprises arrangements for generating time information, i.e. a clock for indicating the time and a dater indicating the date. This time information is registered together with the picture of the vehicle to be monitored, usually in a manner reflected in the picture (German Democratic Republic Patent 66,974).

Furthermore, it is well known that a sequence of speed measuring values can be generated by means of a Doppler radar while vehicles to be monitored pass the radar beam. These speed measuring values are classified in a memory such that a histogram is obtained, i.e. a frequency distribution of these speed measuring values. Conclusions of passing actions or the like can be drawn from such a histogram. It is also possible to infer the type of the passing vehicle from the histogram, i.e. whether the vehicle is a passenger car or a motor lorry.

Furthermore, for the purpose of traffic count, it is well known that sensors can be imbedded, for example in the form of induction loops, in the road and can detect the number of passing vehicles for statistical purposes.

DISCLOSURE OF INVENTION

This invention is based on the fact that, in traffic monitoring devices of the type mentioned above, a variety of information about traffic events is obtained, in a way, as "by products", which are of interest for traffic planning and possibly also for the resolution of a single registered violation. However, these types of information are not detected in the previously described devices. These types of information are of particular interest because such traffic monitoring devices usually are placed in focal points of the traffic, where statistical documents about density of traffic, temporal distribution of the traffic and frequency of violation of traffic regulations are of great importance for the traffic planning and control.

Accordingly, it is the object of the invention to enable such additional information obtained in traffic monitoring devices to be useful.

Furthermore, it is the object of the invention to make the evaluation of the detected violations easier by means of electronic data processing.

According to the invention, this object is achieved by an electronic memory adapted to memorize events detected by the device for later evaluation.

Therewith, not only the vehicles violating a traffic regulation and being photographed can be detected, but every vehicle passing the device. Thus, the density of traffic can be determined as well as the temporal distribution of the density of traffic by means of the clock and the dater which are already present. The number of violations can be related to the density of traffic, or the temporal distribution of the violations can be determined. If the device can distinguish passenger cars from motor lorries, for example, due to a histogram, even this can be statistically evaluated.

Furthermore, conclusions of the traffic situation at the moment of a certain violation can be drawn from the statistical evaluation. It can, for example, be determined whether it was heavy traffic or the road was empty in the time interval during which, for example, a monitored vehicle was driven at excessive speed.

However, the electronically memorized data of the determined violations can also be used to make, for example, the formal recording (writing a report) of the violation by means of electronic data processing. The memorized data (e.g. date, time, site and speed) merely have to be characterized by a number, which also is shown on the picture. The evaluating officer just has to register the license number of the vehicle shown in the picture in a written form or printed out by a computer according to the data in its memory. Thus, a considerable relief on the police workload from routine writing can be achieved.

BRIEF DESCRIPTION OF THE DRAWINGS

Embodiments of the invention will now be described in greater detail with reference to the accompanying drawings.

BEST MODE OF CARRYING OUT THE INVENTION

Figure 1:
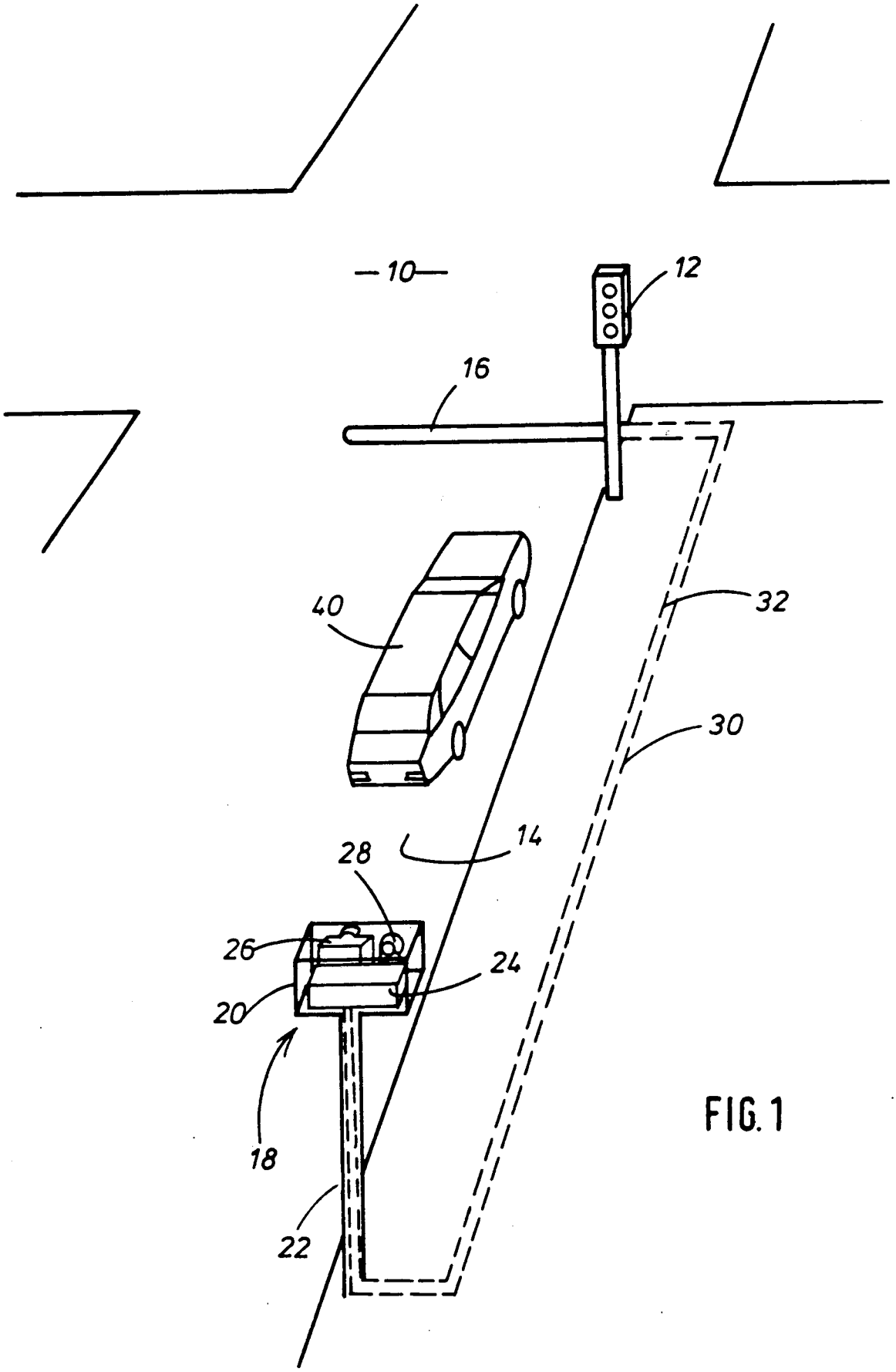
FIG. 1 is a schematic-perspective illustration of a road intersection controlled by a traffic light having a device for photographic monitoring of this road intersection.

FIG. 1 is a schematic-perspective illustration of a road intersection 10, which is controlled by a traffic light 12. The other traffic lights of the road intersection are not shown in order to simplify the illustration. A sensor 16 in the form of an induction loop is imbedded in the road carpet of a road 14 joining the road intersection just before the junction with the road intersection 10. The sensor 16 responds if a vehicle 40 passes over.

A device 18 for photographic monitoring of the road intersection 10 is arranged in a housing 20, which is arranged on a support 22 shortly spaced from the road intersection 10. The device 18 comprises a signal processing unit 24, a photographic camera 26 controlled by the signal processing unit and a flash light device 28. The signal processing unit 24 receives a sensor signal from the sensor 16 through a line 30 and a stop phase signal from the traffic light 12 through a line 32 when the traffic light changes-over to stop phase.

Figure 2:
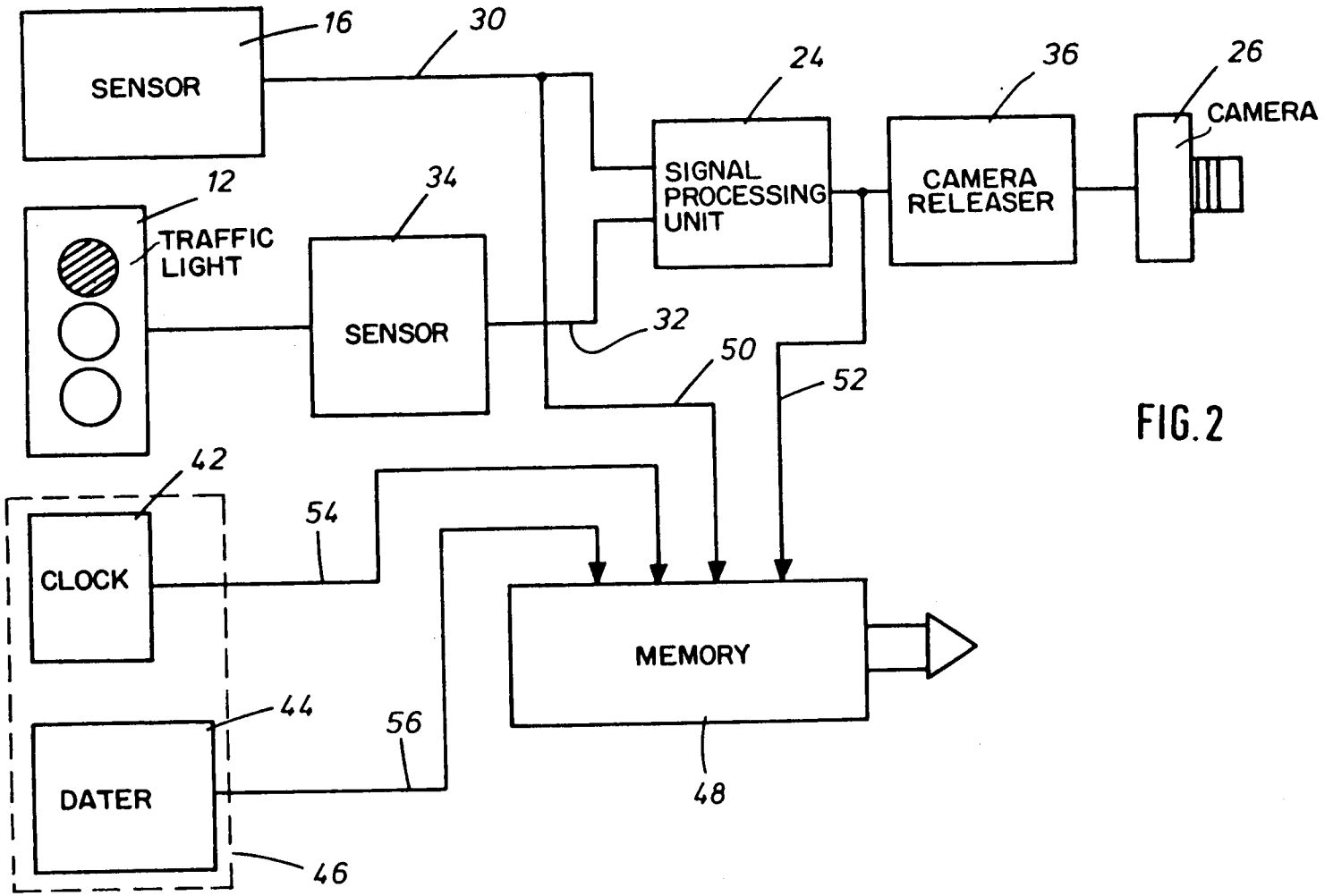
FIG. 2 is a block diagram of a device for monitoring a road intersection controlled by a traffic light having a memory for memorizing the detected events.

As can be seen from the block diagram of FIG. 2, the traffic light 12 comprises a sensor 34, which supplies the stop phase signal. The signal processing unit 24 supplies a releasing signal to a camera releaser 36 when a sensor signal appears during the stop phase. Then the camera releaser 36 releases the camera 26. Then the camera takes a picture of the road intersection 10 with the traffic light 12 showing stop phase and of the vehicle 40 (FIG. 1), which has released the sensor signal. Furthermore, a clock 42 and a dater 44 are provided. These form means 46 for generating time information. The indications of clock 42 and dater 44 are reflected in the picture or registered in another way on the film.

Usually at least two pictures are taken when the sensor 16 responds during the stop phase. The sensor 16 is arranged to prevent additional releases of the camera between these two pictures and also during the time required for feeding film for photographing a next vehicle. Furthermore, the sensor 16 is also arranged to detect a further vehicle, which might enter a road intersection between the time at which these two pictures are taken.

A memory 48 is provided in such a device for monitoring a road intersection controlled by a traffic light. This memory is arranged to memorize the events detected by the device for later evaluation for statistical purposes.

The sensor 16 is adapted to apply the sensor signals through a line 30. These supply the total number of all vehicles entering the road intersection, regardless as to whether these vehicles enter the road intersection during stop phase and are photographed or not. This information gets lost with usual devices of this type. Furthermore, the memory 48 receives through a line 52 the signals from the signal processing unit 24, which actuates the camera releaser 36. These signals supply a record of the number of detected violations. Finally the memory 48 also receives time information from the clock 42 through a data line 54 and from the dater 44 through a data line 56.

The memory can be part of a microprocessor, in which the information is classified so that, for example, the number of the events obtained in predetermined time intervals (pulses on the lines 50 and 52, respectively) are recorded together with the associated time information (time and date).

The information thus obtained when the device is in operation can be statistically evaluated later. For example, the density of traffic on the road 14 can be determined as a function of time. The relation of the number of violations to the total number of the vehicles having passed can be determined as well as whether this relation varies with time or with density of traffic. It can also be determined what influence adjustments to the traffic light, for example, prolongation of the "yellow phase", have on the absolute and relative number of the registered violations. The recorded data of different devices of the preset type arranged at traffic focal points in a town supply a regular survey of the traffic events in the town and thus documents for the traffic planning. All this is obtained by using components already present with a relatively small additional expenditure.

Figure 3:
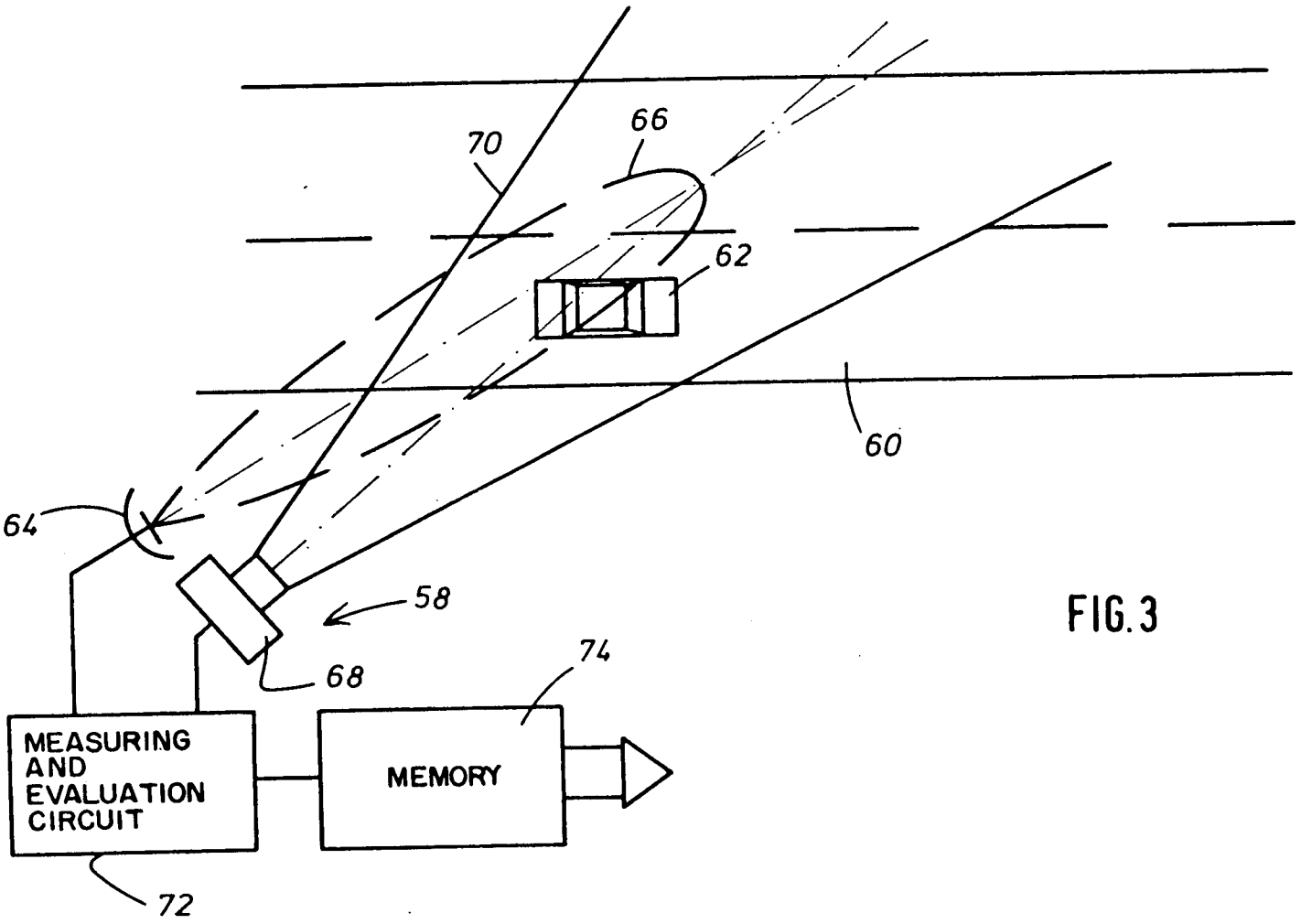
FIG. 3 is a schematic illustration of a speed monitoring device operating with Doppler radar.

FIG. 3 shows schematically a speed monitoring device operating with Doppler radar. The device 58 is arranged laterally to the side of a road 60. Numeral 62 designates a vehicle to be monitored. The device 58 comprises a radar antenna 64 emitting a "radar lobe" 66, which is indicated by broken lines. The "radar lobe" illustrates the emitted radiation energy per solid angle as a function of the angle. Furthermore, the device 58 comprises a photographic camera 68, which detects a field of view 70. The signals from the radar antenna 64 are applied to a measuring and evaluation circuit 72. The measuring and evaluation circuit supplies speed measuring values when the vehicle 62 passes through the radar lobe. When the vehicle 62 exceeds an allowed maximum speed limit the camera 68 is released. Therein the camera 68 is released at a moment, in which the vehicle 62 is located substantially in the center of the field of view 70 of the camera 68.

Information, which is supplied by the measuring and evaluation circuit and which also includes the number of the passing vehicles (regardless as to whether they are driven too fast or not), are recorded in a memory 74 for the later statistical evaluation.

Figure 4:
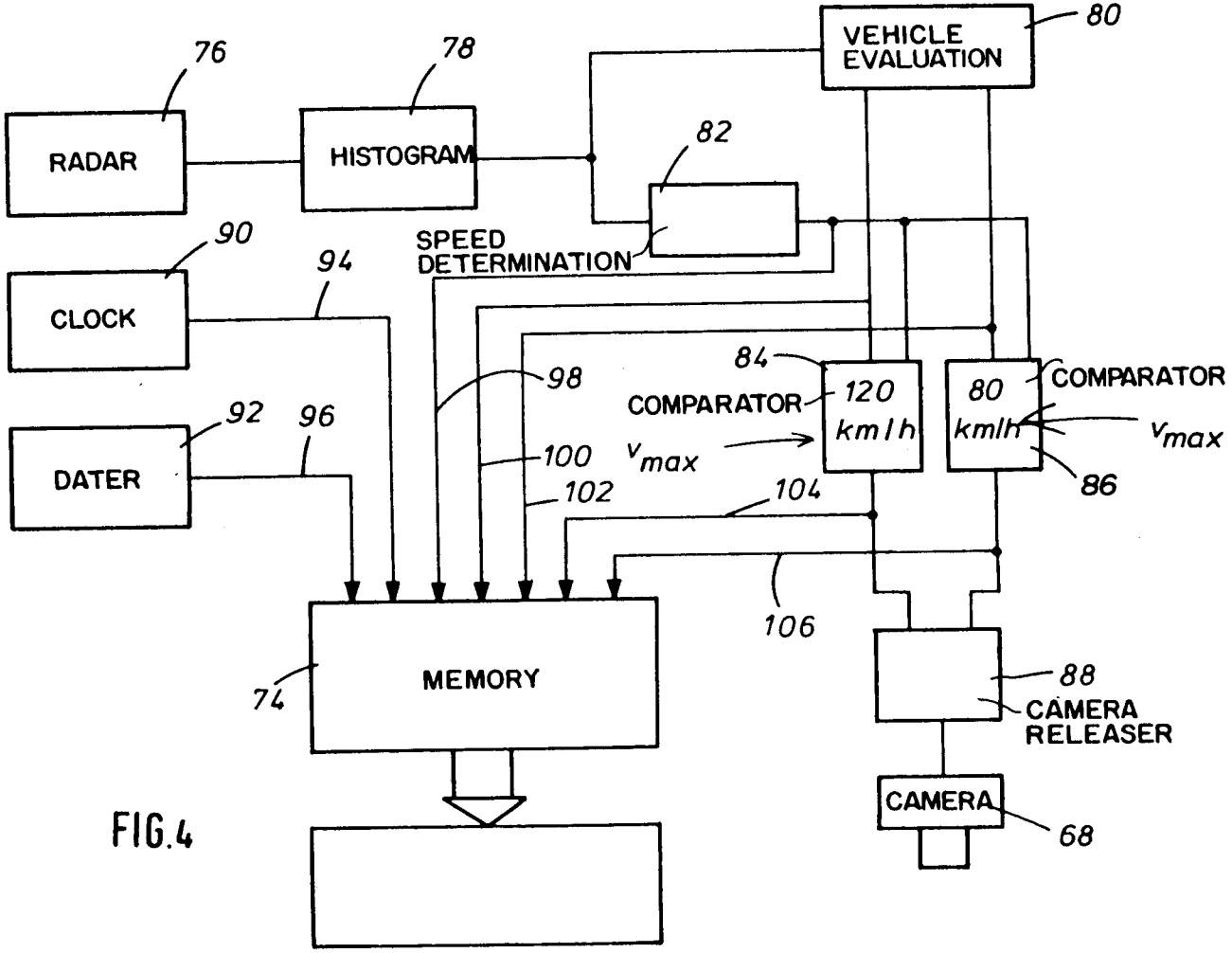
FIG. 4 is a block diagram of the speed monitoring device of FIG. 3.

In FIG. 4 the device 58 is illustrated schematically as a block diagram. A Doppler radar 76 including the radar antenna and the associated transmit-receive device and an evaluation circuit supplies speed measuring values. The speed measuring values are grouped into a histogram, i.e. a distribution of the frequencies of speed measuring values on different speed classes. From this histogram, the occurrence of two vehicles passing by, or the like, can be recognized, which would otherwise lead to causing incorrect measuring values to be applied that might suppress each other and not cause the camera to release. It can also be recognized whether the detected vehicle is a passenger car or a motor lorry. Furthermore, a measuring value of the speed of the monitored vehicle 62 results from the histogram. In FIG. 4 the evaluation "passenger car/motor lorry" is symbolized by a block 80. The determination of the speed from the histogram is illustrated by a block 82. The evaluation "passenger car/motor lorry" actuates a comparator 84 or 86. The measuring value of the speed of the vehicle 62 is applied by block 82 to the comparators and is compared in each of the comparators to a predetermined allowed maximum speed limit of, for example 120 km/h and 80 km/h, respectively. A releasing signal is applied to a camera releaser 88 when the measuring value is higher than 120 km/h or higher than 80 km/h depending on the type of vehicle. Then the camera releaser 88 releases the camera 68. At the same time the time from a clock 90 and the date from a dater are reflected in the picture thus taken.

This technique is known, per se, and is therefore not described in detail herein.

The different varieties of information obtained with this device are applied to the memory 74. In detail, the memory 74 receives the time from the clock 90 through a data line 94 and the date from the dater 92 through a data line 96. Furthermore, the memory 74 receives the measuring value of the speed from block 82 through a data line 98. Furthermore, the memory 74 receives pulses from the evaluation "passenger car/motor lorry" 80 through line 100 or 102, respectively, depending on whether a passenger car or a motor lorry is determined. Finally, the memory 74 receives pulses from the comparator 84 and 86 through line 104 and line 106, respectively, when a vehicle has exceeded the allowed maximum speed limit predetermined for its vehicle type, and a releasing pulse is applied to the camera releaser.

Also herein a summation of the events and classing according to speeds and/or time can be effected in the memory 74. Also in this device, information about non-photographed vehicles is obtained as "by products" and can be detected and statistically evaluated with relatively small expenditure. Of course, it is not required to memorize all of the information mentioned herein, when not all of the information shall be evaluated.

The statistical evaluation can also be important for the judgment of a single detected violation. Thus, exceeding of the allowed maximum speed limit can be more or less serious depending on whether it was heavy traffic or the road was almost empty at the time in question.

Finally, the electronic memorization of data associated with a detected violation of the traffic regulations can be used to relieve the police in processing the determined violations. The actual data recorded in the electronic memory can be used to write or fill out forms for a report or a notice of payment due by means of a computer. From the memory these forms then receive date, time, site and type of the violation. The police just have to register the licence number of the vehicle from the photographic picture in such a form.

This routine work with the evaluation of the picture takes a lot of time and constitutes often the limiting factor when applying automatically operating traffic monitoring devices: there is no sense in determining more violations and taking more pictures than it is possible to process later with the available personnel.

We claim:

1. A traffic monitoring device comprising:
(a) sensor means responding to the passage of vehicles for providing vehicle passage signals,
(b) means for detecting violations of traffic regulations by passing vehicles and signalling a camera means,
(c) photographic camera means for recording such a vehicle, the photographic camera means being released to take a photograph upon receiving said signalling from the violation detecting means,
(d) clock means for providing time information associated with said passage of said vehicles.
(e) electronic memory means arranged in said traffic monitoring device and connected to said sensor means and to said clock means for memorizing, for later evaluation, the number of all said vehicle passage signals and the respective times of passage of said vehicles past said sensor means, irrespective of whether or not a violation of traffic regulations has occurred,
(f) wherein violation detecting means and said clock means are arranged in a unit arranged at the side, where the traffic is to be monitored, and said memory means are also arranged in said unit.

2. A traffic monitoring device as claimed in claim 1, wherein said electronic memory means are also connected to said violation detecting means for memorizing said detected violations of traffic regulations together with the associated time information.

3. A traffic monitoring device as claimed in claim 1, wherein said violation detecting means comprise means for measuring the speed of vehicles passing by, said speed measuring means being also connected to said electronic memory means for memorizing the speeds of said vehicles for later statistical evaluation regardless of whether such speeds are excessive or not.

4. A traffic monitoring device as claimed in claim 1, wherein said violation determining means comprise means for discriminating between passenger cars and motor trucks, said discriminating means being also connected to said memory means for memorizing the numbers of passenger cars and trucks passing by.

5. A traffic monitoring device comprising:
sensor means responding to the passage of vehicles for providing vehicle passage signals,
clock means for providing time information associated with said passage of said vehicles.
means for detecting violations of traffic regulations by passing vehicles, said violation detecting means comprising means for measuring the speed of vehicles passing by and the means for detecting violations associating with means for signalling to a camera means upon detecting a violation,
said violation detecting means and said clock means being arranged in a unit located at the site, where the traffic is to be monitored.
photographic camera means operable for photographing, on a photographic film, only violating vehicles, said camera means being controlled to take a photograph upon receiving a signal from said means for signalling associating with the violation detecting means and electronic memory means arranged in said unit of said traffic monitoring device and connected to said sensor means and to said clock means for memorizing, for later statistical evaluation, the number of said vehicle passage signals and the respective times of passage of said vehicles past said sensor means, irrespective of whether or not a violation of traffic regulations has occurred said speed measuring means being also connected to said electronic memory means for memorizing the speeds of said vehicles for later statistical evaluation regardless of whether such speeds are excessive or not.

6. A traffic monitoring device as claimed in claim 5, wherein said violation determining means comprise means for discriminating between passenger cars and motor trucks, said discriminating means being also connected to said memory means for memorizing the numbers of passenger cars and trucks passing by.

* * * * *